US010495083B2

(12) United States Patent
Stockner et al.

(10) Patent No.: US 10,495,083 B2
(45) Date of Patent: Dec. 3, 2019

(54) RECIPROCATING PUSHROD ASSEMBLY AND CRYOGENIC PUMP

(71) Applicant: Caterpillar Inc., Peoria, IL (US)

(72) Inventors: Alan Stockner, Metamora, IL (US); Aaron M. Brown, Peoria, IL (US); Sridhar Thangaswamy, Dunlap, IL (US); Dana R. Coldren, Secor, IL (US); Dennis Gibson, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 274 days.

(21) Appl. No.: 15/609,493

(22) Filed: May 31, 2017

(65) Prior Publication Data

US 2018/0347560 A1 Dec. 6, 2018

(51) Int. Cl.
*F04B 53/14* (2006.01)
*F04B 15/06* (2006.01)

(52) U.S. Cl.
CPC ..... *F04B 53/144* (2013.01); *F04B 15/06* (2013.01); *F04B 53/14* (2013.01); *F04B 53/143* (2013.01)

(58) Field of Classification Search
CPC ..... F04B 53/144; F04B 53/14; F04B 15/06; F04B 53/143; F04B 15/08
See application file for complete search history.

(56) References Cited

U.S. PATENT DOCUMENTS

| | | | | |
|---|---|---|---|---|
| 5,575,626 | A * | 11/1996 | Brown | F04B 15/08 417/251 |
| 6,530,761 | B1 * | 3/2003 | Chalk | F04B 5/02 417/552 |
| 6,547,250 | B1 | 4/2003 | Noble et al. | |
| 7,223,080 | B2 | 5/2007 | Duron | |
| 8,671,700 | B2 | 3/2014 | Duong et al. | |
| 9,915,250 | B2 * | 3/2018 | Brasche | F04B 37/08 |
| 9,915,251 | B2 * | 3/2018 | Coldren | F04D 13/06 |
| 10,267,315 | B2 * | 4/2019 | Chalmers | F04D 13/086 |
| 2013/0215766 | A1 | 8/2013 | Zhou et al. | |
| 2014/0334947 | A1 | 3/2014 | Hackett | |
| 2016/0146199 | A1 | 5/2016 | Pollard et al. | |

* cited by examiner

*Primary Examiner* — Abiy Teka
(74) *Attorney, Agent, or Firm* — Jonathan F. Yates

(57) ABSTRACT

A pushrod assembly 5 may include a seal carrier 50 for a spaced seal assembly 60 and/or a seal carrier 70 for a stacked seal assembly 74, the spaced seal assembly including first and second annular seals 61, 62 separated by a spacer 63 to isolate between the seals a vented region 28 of the pushrod housing 6, the stacked seal assembly including at least two annular seals 80 stacked on the seal carrier. Each seal assembly can be removed and replaced via an access end 52, 72 of the seal carrier after detaching the access end from an adjacent component of the assembly. The seal carriers may be incorporated into a cryogenic pump 2 wherein at least one annular seal is arranged on each seal carrier to seal the pushrod assembly 5 within its housing 6.

7 Claims, 6 Drawing Sheets

138
132
133
134
5
130
100
135
130
140
142
74
80
80
72
73
71
75
130
70
136
137
135
138
132
40
41
130
132
53
52
51
$D_1$
51
54
50
130
135
90
123
120
130
122
121
65
61
64
63
64
62
66
60

90
91
5
120
122
124
121
53
65
61
63
62
66
50
140
141
73
70
40
100

RECIPROCATING PUSHROD ASSEMBLY AND CRYOGENIC PUMP

TECHNICAL FIELD

This invention relates to reciprocating pushrod assemblies for use in pumps, including in particular cryogenic pumps.

BACKGROUND

Cryogenic pumps are pumps for use in pumping cryogenic fluids, i.e. fluids at cryogenic temperatures, including for example liquefied fuel gases such as liquefied natural gas (LNG). In this specification, cryogenic temperatures are taken to be temperatures below −100° C., typically below −150° C.

Cryogenic pumps may be used for example to transfer cryogenic fluids during production and transportation or to deliver a cryogenic fuel to an internal combustion engine such as a reciprocating dual fuel compression ignition engine. Such engines operate on a mixture of a gaseous fuel, such as natural gas, and a petroleum distillate fuel, such as diesel, but require high gaseous fuel pressures in order to achieve high power density at high gaseous fuel-to-petroleum distillate substitution rates.

In such applications it is known to pump a cryogenic fluid by driving a cryogenic pumping element, e.g. a piston reciprocating in a cylinder, via a pushrod assembly powered by an actuator such as a hydraulically driven piston. The elongate pushrod helps to thermally separate the cryogenic pumping element at the cold end of the assembly and the hydraulic actuator at the (relatively) warm end, so that the hydraulic drive components are able to operate at ambient temperature to provide the required fuel pressure.

For example, US 2014/334947 discloses a reciprocating pump assembly suitable for pumping LNG, comprising a drive rod and a pump rod with crowned ends. The drive rod and pump rod are releasably coupled together in axial relation by a connector which accommodates slight misalignment.

If a hydraulic actuator is used to drive the cryogenic pumping element then an effective sealing system is required to ensure that the hydraulic fluid does not contaminate the LNG or other cryogenic fluid, or vice-versa. However, this can be difficult in cryogenic service conditions, particularly in view of the different coefficients of thermal expansion of cryogenic sliding seal materials such as polytetrafluoroethylene (PTFE) and ultra high molecular weight polyethylene (UHMWPE) relative to that of stainless steels and other materials commonly used for pistons and other cryogenic pump components.

It is known to install an annular seal between a shaft and its housing by stretching and sliding the seal axially along the shaft. However, it can be difficult to install and remove such seals while ensuring adequate energisation in the use position after the seal relaxes into a groove in the shaft. In cyrogenic applications, leakage may result from thermal contraction of the shaft.

It is also possible to exploit differential thermal expansion to provide sealing in a cryogenic system which operates at a constant temperature. For example, U.S. Pat. No. 6,547,250 discloses a cryogenic shaft seal assembly comprising a spring energised seal supported by a static metal seal shrunk onto the shaft.

However, in many cryogenic systems the service temperature is not constant. For example, in mobile applications large temperature changes occur due to normal service and refuelling cycles. When the pump is not in use, the warm end of the assembly will lose heat by conduction to the cold end at a rate depending inter alia on the ambient temperature at the warm end which also fluctuates with the operating environment of the vehicle.

The use of an exposed pushrod to couple an actuator to a pumping element arranged at a distance from the actuator avoids cross-contamination between the hydraulic and cryogenic fluids due to leakage at the seals. However, it is more difficult to avoid cross-contamination when the pushrod must be enclosed in a housing, for example, in order to provide a more compact assembly to provide fuel to a vehicular engine, since the housing provides a path through which leaking fluids may migrate.

US 2016/0215766 A1 discloses a pump for a cryogenic fluid comprising pistons operated by oil lubricated pushrods. The pushrods have oil seals and vents to relieve pressure from the annular space between the pushrods and the housing to reduce leakage through the oil seals.

SUMMARY OF THE INVENTION

In a first aspect, a pushrod assembly is disclosed for use in a pump having a housing with a vented region. The pushrod assembly includes a plurality of pushrod components operatively connected together in series along an axis of the assembly to transmit reciprocal motion between a driving end and a driven end of the assembly, said pushrod components including a spaced seal assembly carrier. The pushrod assembly further includes a spaced seal assembly, the spaced seal assembly including at least a first annular seal, a second annular seal, and an annular spacer. The spaced seal assembly carrier extends axially through the spaced seal assembly with the spacer axially interposed between the first annular seal and the second annular seal, each of the first annular seal and the second annular seal being received on a respective seat region of the spaced seal assembly carrier and retained between axially opposed abutment surfaces of the pushrod assembly. The pushrod assembly is receivable in the housing of the pump in a use position wherein the first and second seals slidingly engage the housing and sealingly isolate the vented region of the housing between the first annular seal and the second annular seal. The spaced seal assembly carrier has an access end and is detachably connectable at the access end to an adjacent one of the pushrod components so that when detached the access end can be slidingly axially inserted into the spaced seal assembly.

In a further aspect, a pushrod assembly is disclosed for use in a pump having a housing. The pushrod assembly includes one or more pushrod components configured to transmit reciprocal motion along an axis of the assembly between a driving end and a driven end of the assembly, said one or more pushrod components including a stacked seal assembly carrier. The pushrod assembly further includes a stacked seal assembly, the stacked seal assembly including at least two annular seals. The stacked seal assembly carrier extends axially through the stacked seal assembly, the at least two annular seals being arranged in series on a seat region of the stacked seal assembly carrier and retained between axially opposed abutment surfaces of the pushrod assembly. The pushrod assembly is receivable in the housing of the pump in a use position wherein the at least two annular seals slidingly engage the housing. Each of the at least two annular seals is configured to be biased radially outwardly by fluid pressure from the driven end of the assembly. The stacked seal assembly carrier has an access end and is detachably connectable at the access end to an adjacent one of the one or more pushrod components so that when detached the access end can be slidingly axially inserted into the stacked seal assembly.

In a yet further aspect, a cryogenic pump assembly is disclosed for pumping a cryogenic liquid. The cryogenic pump assembly includes a housing and a pushrod assembly. The pushrod assembly includes a plurality of pushrod components operatively connected together in series along an axis of the pushrod assembly to transmit reciprocal motion between a driving end and a driven end of the pushrod assembly, said pushrod components including in series relation: an actuator at the driving end, and then a first seal carrier, and then an elongate pushrod, and then a second seal carrier, and then a cryogenic pumping element at the driven end. The pushrod assembly further includes at least one annular seal received on a seat region of the first seal carrier and at least one annular seal received on a seat region of the second seal carrier. Each of the first seal carrier and the second seal carrier is arranged within the housing and extends axially through the respective at least one annular seal so that each seal is retained between axially opposed abutment surfaces of the pushrod assembly to slidingly engage the housing. Each seal carrier has an access end and is detachably connected at the access end to an adjacent one of the pushrod components so that when detached the access end can be slidingly axially inserted into the respective at least one annular seal.

BRIEF DESCRIPTION OF THE DRAWINGS

Further features and advantages will become evident from the following illustrative embodiment which will now be described, purely by way of example and without limitation to the scope of the claims, and with reference to the accompanying drawings, in which:

Reference numerals appearing in more than one of the figures indicate the same or corresponding parts in each of them.

DETAILED DESCRIPTION

Figure 1:
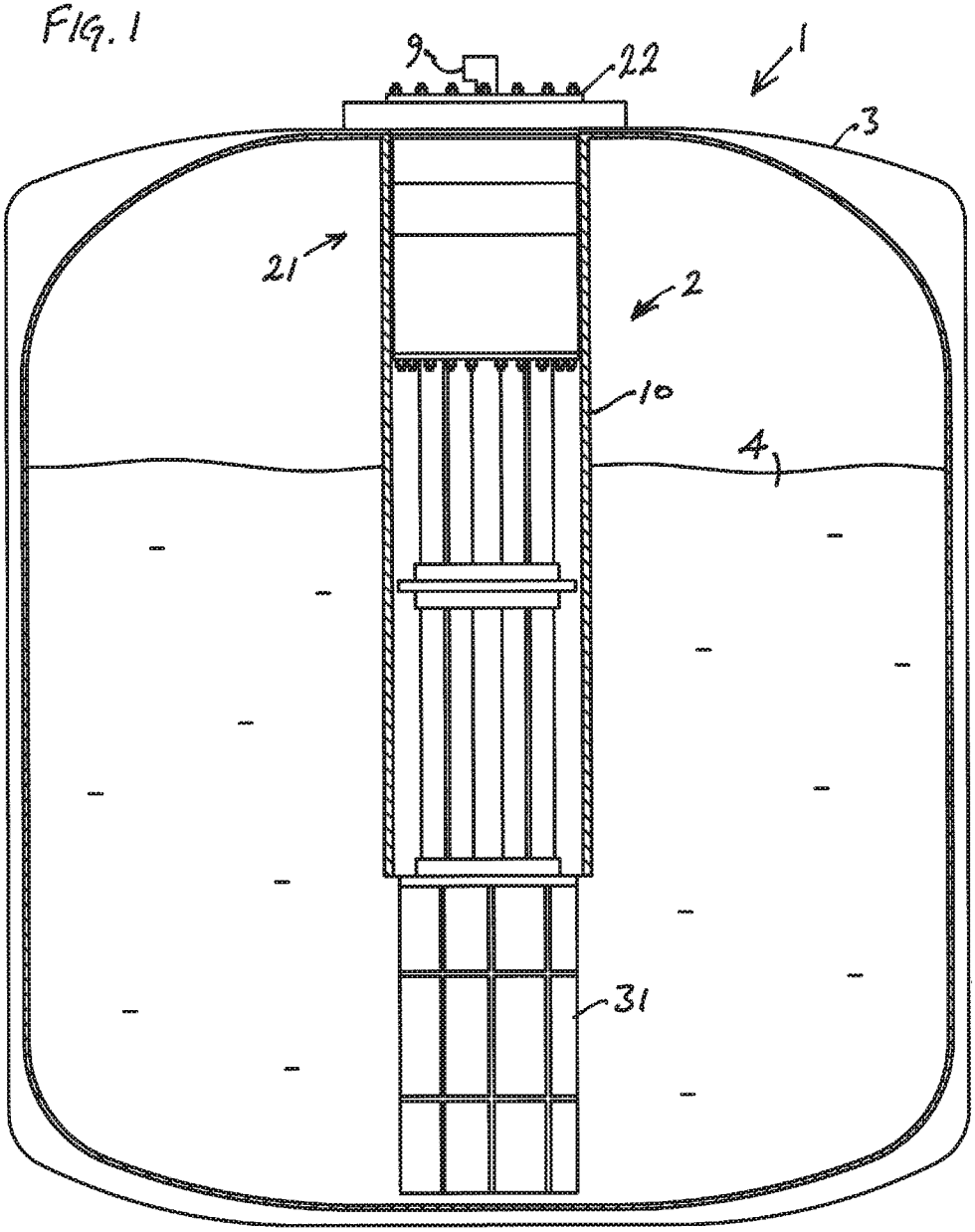
FIG. 1 is a longitudinal section through a fuel tank containing liquefied natural gas (LNG) with a cryogenic pump mounted within the tank for supplying LNG to an engine.
Figure 2:
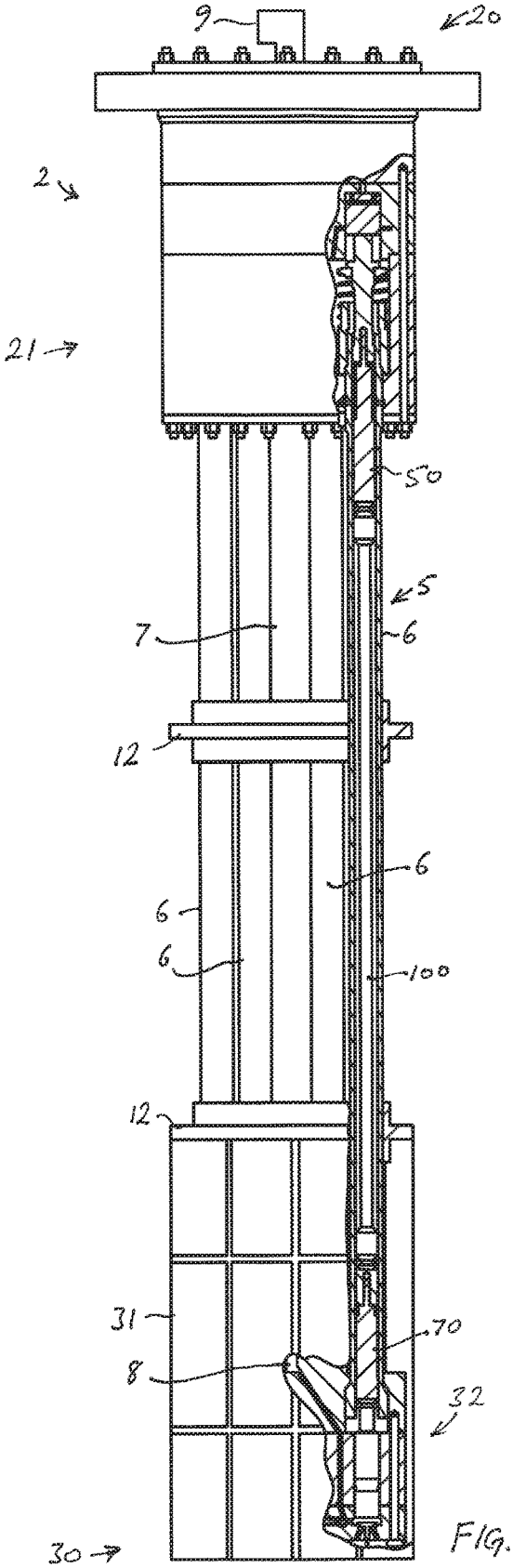
FIG. 2 shows the cryogenic pump with the housing partially cut away to reveal one pushrod assembly, also partially sectioned.

Referring to FIGS. 1 and 2, a cryogenic pump assembly 1 includes a pump 2 mounted in an insulated tank 3 containing a cryogenic liquid 4 such as liquefied natural gas (LNG). The tank may be mounted on a mobile machine, for example a locomotive, mining truck, etc., to supply a cryogenic fuel at high pressure to an engine. As a non-limiting example, it may be arranged to supply LNG to a reciprocating dual fuel compression ignition engine operating on a combination of LNG and a petroleum distillate, such as diesel fuel.

The pump has a drive assembly 21 including a mounting flange 22 at its warm, upper end, also referred to as the driving end 20 since it contains the hydraulically powered drive components, and is fixed by the flange 22 in the top of the tank.

The pump includes six identical pushrod assemblies 5, each of which is received in a fixed guide tube or pushrod housing 6, made from a material selected and/or treated to be suitable for cryogenic service as known in the art. The pushrod housing 6 may be a single part or an assembly of several parts, and may have a bore which is polished in its end regions which receive the reciprocating seal assemblies while being only semi-finished in its central region which receives the reduced diameter, central region 101 of a central pushrod 100.

The six pushrod housings 6 are arranged (when considered in plan view) in a hexagonal configuration around a central high pressure supply tube 7 which extends from an inlet manifold 8 at its lower end to a high pressure fuel outlet 9 at its upper end.

The hexagonal bundle of pushrod housings is received in an insulated socket 10 which extends downwardly into the tank to separate the pushrod housings from the cryogenic liquid, so that each pushrod housing 6 forms an inner barrier between the cryogenic liquid and the respective pushrod assembly. The pushrod housings pass through flanges 12 which support the assembly and act as additional barriers to prevent the migration of liquid or vapor. The cold, lower end of the pump is also referred to as the driven end 30 since it contains the cryogenic pumping elements 40, and extends into a filter 31 which forms a permeable casing around it so that together with the filter it is at least partially immersed in the cryogenic liquid within the tank.

Figure 4:
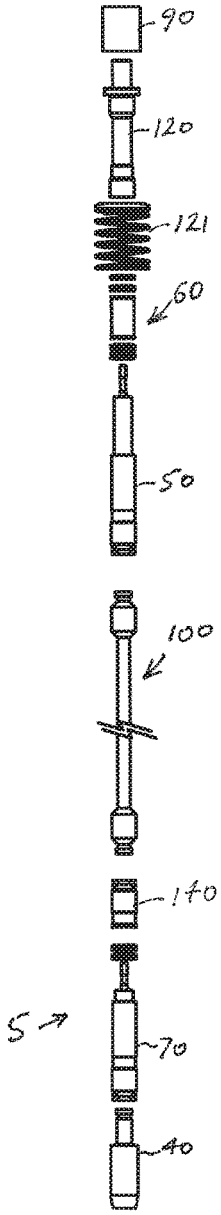
FIGS. 3 and 4 show the pushrod assembly respectively assembled and disassembled.
Figure 3:
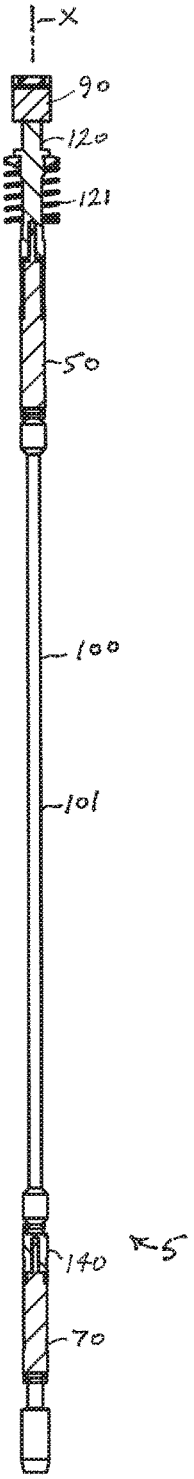

Referring to FIGS. 3 and 4, each pushrod assembly includes one or more pushrod components, preferably as shown a plurality of pushrod components, which are operatively connected together in series along a length axis X of the assembly as shown in FIG. 3 and configured to transmit reciprocating motion between the driving end 20 and the driven end 30 of the assembly. The pushrod components may include a spaced seal assembly carrier 50, which may be arranged at (i.e. proximate) the driving end 20 of the assembly; a stacked seal assembly carrier 70, which may be arranged at (i.e. proximate) the driven end 30 of the assembly; or a combination of first and second seal carriers (which is to say, seal assembly carriers) 50, 70.

Figures 5, 6:
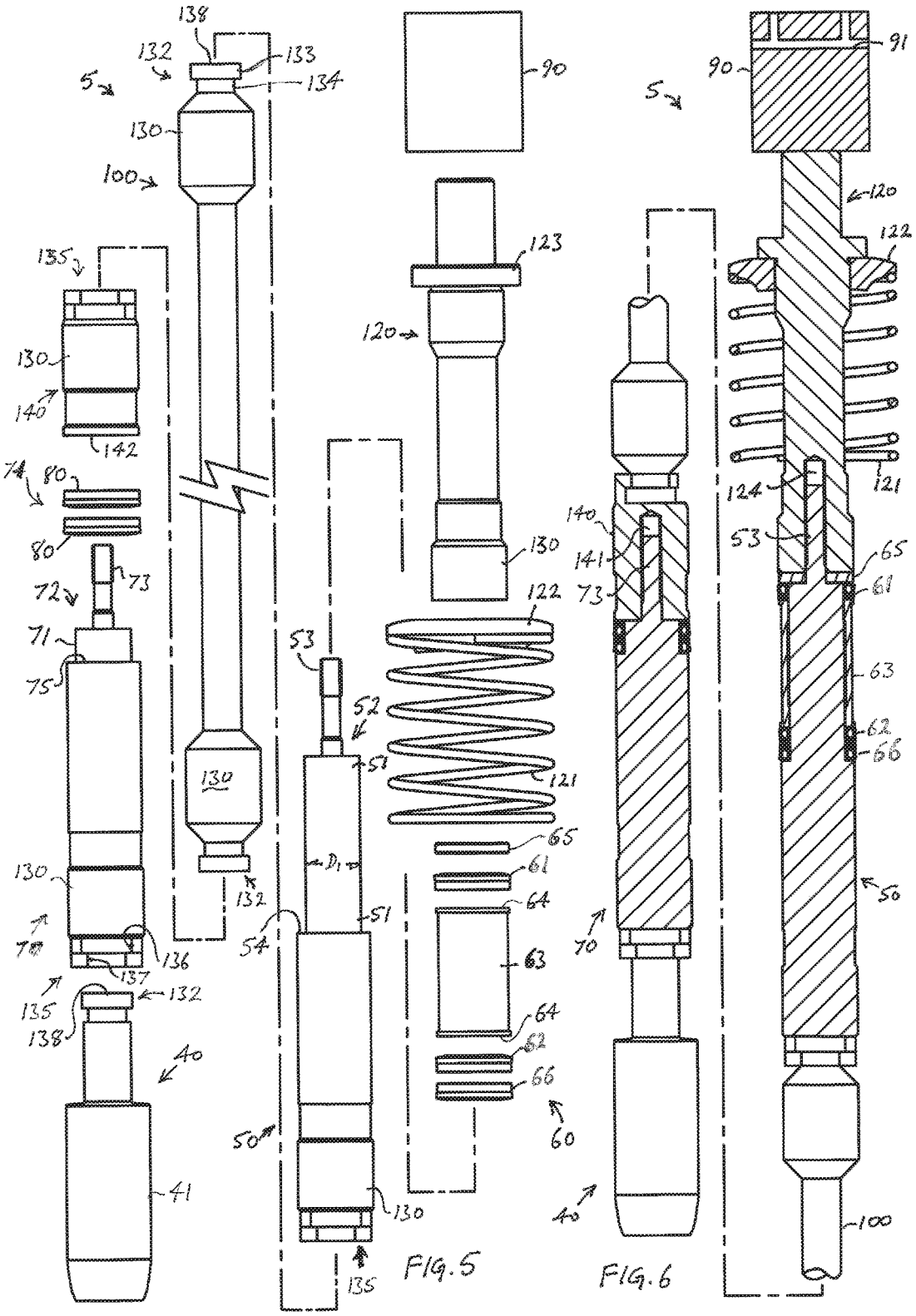
FIG. 5 shows the pushrod assembly in a disassembled condition.
FIG. 6 shows the pushrod assembly in an assembled condition and partially sectioned.

Referring to FIGS. 5 and 6, at least one annular seal 80 is arranged on a respective seat region 51, 71 of each seal carrier, which extends axially through the respective annular seal. Each seal carrier (i.e. seal assembly carrier) has an access end 52, 72 and is detachably connected at the access end to an adjacent one of the pushrod components so that when detached the access end can be slidingly axially inserted into the respective at least one annular seal 80. The seal is thus retained between axially opposed abutment surfaces of the pushrod assembly to slidingly engage the housing 6 as the pushrod assembly reciprocates in the housing.

As shown in the illustrated embodiment and best seen in FIGS. 3-6, the pushrod components may include in series relation (and optionally with additional components interposed between them): an actuator 90 at the driving end 20, and then the first seal carrier 50, and then the elongate central pushrod 100, and then the second seal carrier 70, and then the cryogenic pumping element 40 at the driven end 30. As described in more detail below, the first seal carrier may comprise a spaced seal assembly carrier 50 arranged at the driving end of the assembly, and the second seal carrier may comprise a stacked seal assembly carrier 70 arranged at the driven end of the assembly.

Figure 7:
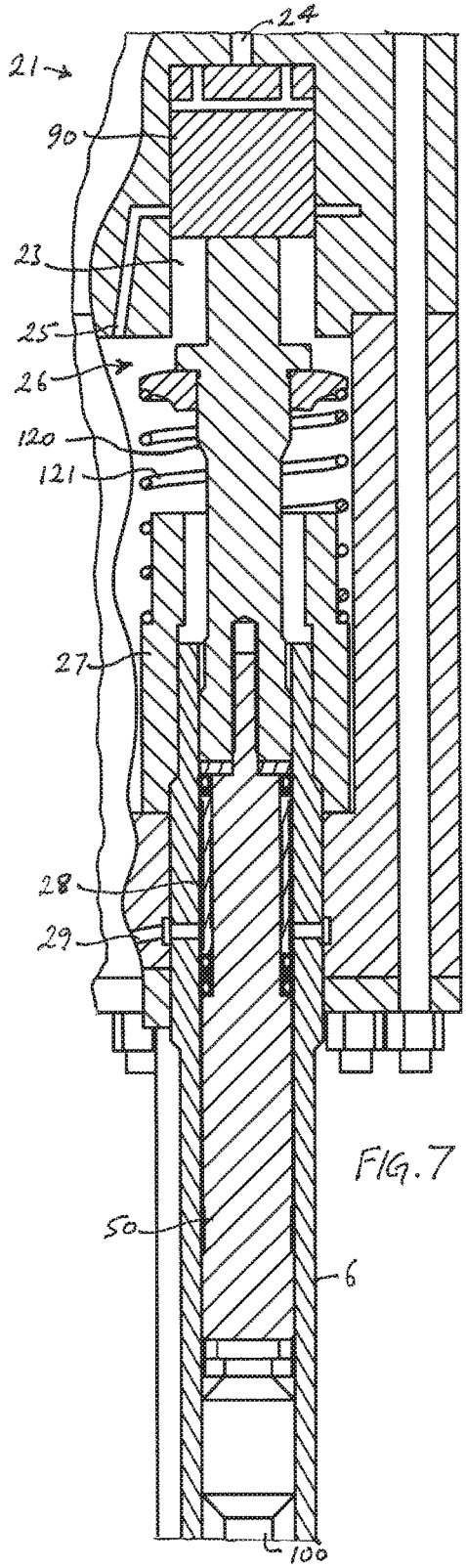
FIG. 7 is a sectional view of part of the drive (warm) end of the cryogenic pump with the pushrod assembly in situ.

Referring also to FIG. 7, in the illustrated embodiment the actuator 90 is hydraulically powered and comprises a piston with an internal fluid passage 91 opening at its outer circumference and at its upper face. The piston is received in a housing 23 in the upper assembly 21 of the pump body and is supplied with hydraulic fluid, e.g. hydraulic oil, via a passage 24 from electrically driven spool valves or other suitable hydraulic control components (not shown) to cause the piston to reciprocate in its housing. When the actuator 90 reaches the end of its downstroke, the internal fluid passage 91 communicates with a corresponding passage 25 in the upper assembly 21 to vent hydraulic fluid to a chamber 26 which is common to all the pushrod assemblies and from which it is returned via a drain (not shown) to a tank. The sudden drop in hydraulic pressure is sensed to indicate the end of the stroke.

Figure 8:
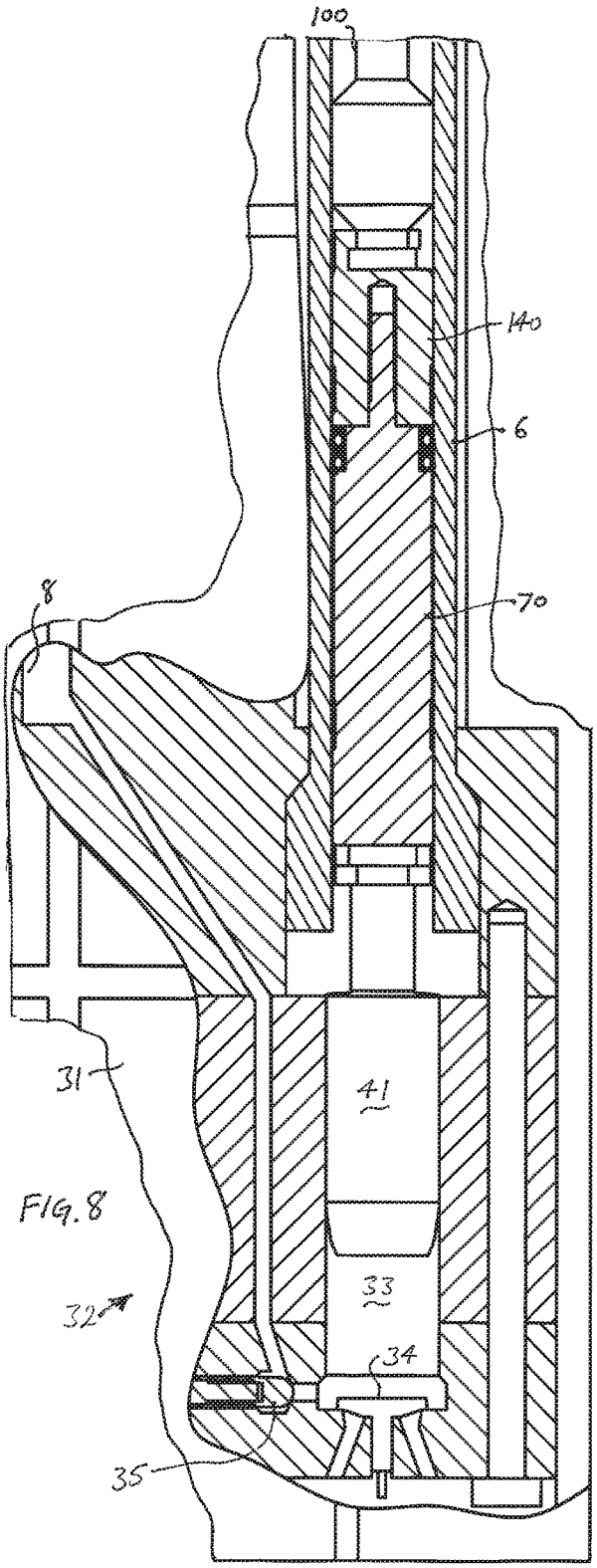
FIG. 8 is a sectional view of part of the pumping (cold) end of the cryogenic pump with the pushrod assembly in situ.

The upper end of the pushrod assembly extends through the chamber 26 and includes a return spring rod 120 which is interposed between the actuator 90 and the spaced seal carrier 50. A return spring 121 is captured between a fixed, lower collar 27 and an upper collar 122 which bears against a flange 123 on the return spring rod to provide a restoring force which urges the pushrod assembly 5 upwardly to a rest position as shown in FIGS. 7 and 8 after each downstroke.

In order to achieve the required fuel pressure, which may be for example up to 10 MPa or more for fuel injection applications, the pressurised surface area of the actuator 90 may be larger than that of the cyrogenic pumping element 40, providing for example approximately a 2:1 surface area ratio as shown in the illustrated embodiment.

In this arrangement it will be appreciated that the pushrod assembly is subjected to a compressive force during each pumping stroke, which is substantially greater than the tension force applied by the return spring to return the pushrod assembly to the rest position, ready for the next stroke. Of course, another actuation arrangement (providing for example, hydraulically or electrically powered motion in either or both directions) could be adopted to provide a similar difference between compression and tension forces, with the compression force being substantially greater than the tension force.

Referring again to FIGS. 5 and 6, the lower end of the return spring rod 120 is provided with an axially central threaded bore or receptacle 124 which receives an axially central threaded stud or shaft 53 extending from the access end 52 of the spaced seal assembly carrier 50. Of course, suitable flat surfaces (not shown) may be provided on each of the pushrod components to be engaged by tools during assembly and disassembly.

Figure 9:
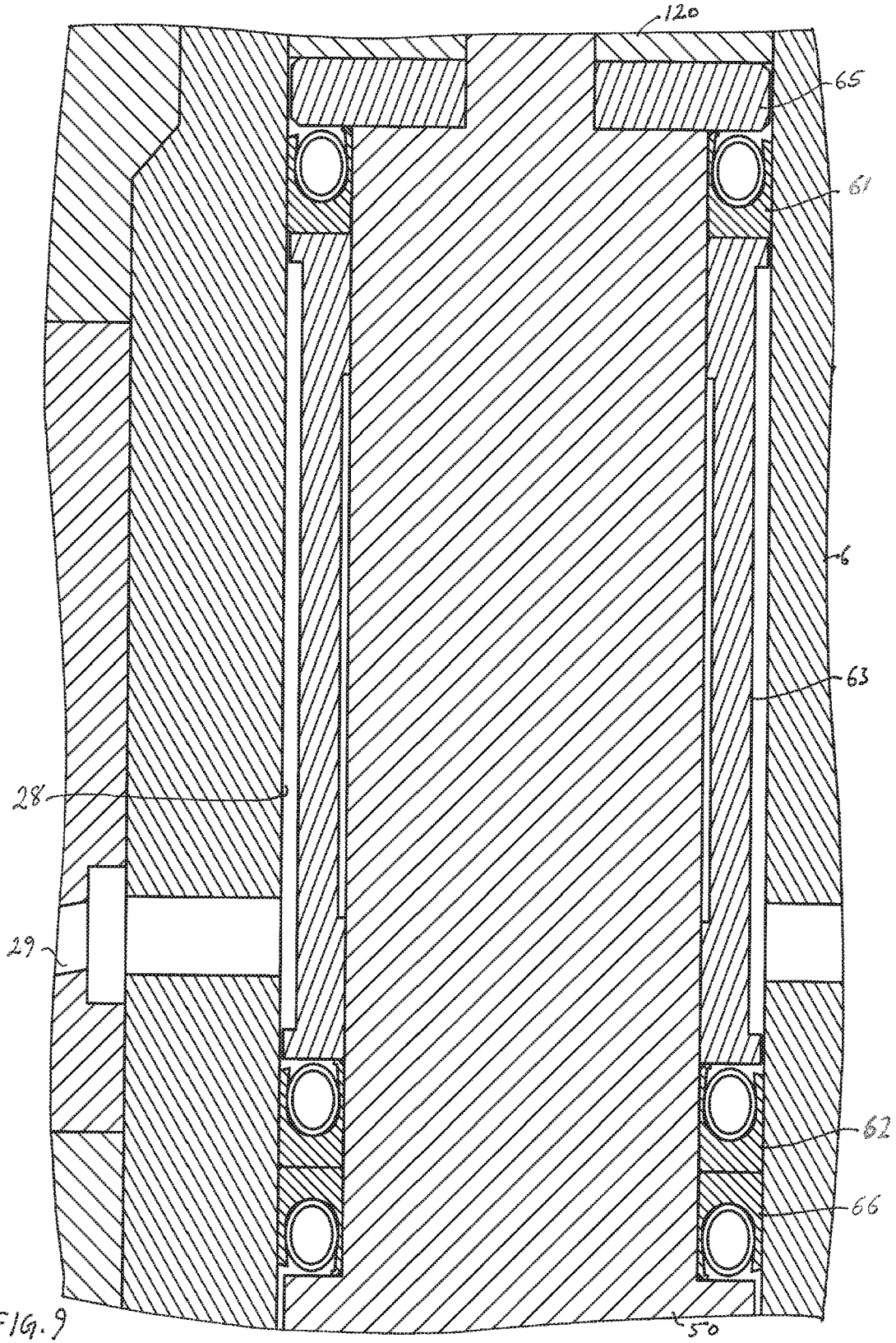
FIG. 9 is an enlarged longitudinal section through part of the spaced seal assembly carrier in its use position in the drive end of the cryogenic pump.

Referring also to FIG. 9, the spaced seal assembly carrier 50 extends axially through a spaced seal assembly 60 which includes at least a first annular seal 61, a second annular seal 62, and an annular, cylindrical spacer 63. The spacer 63 is axially interposed between the first annular seal 61 and the second annular seal 62, each of which is received on a respective seat region 51 of the spaced seal assembly carrier and retained between axially opposed abutment surfaces of the pushrod assembly. It can be seen that the abutment surfaces are formed respectively by a shoulder 54 on the spaced seal assembly carrier, by the opposite axial end faces 64 of the spacer 63, and by the axial end face of a spacer 65 which is arranged in compression between the access end 52 of the spaced seal assembly carrier 50 and the adjacent axial end surface of the return spring rod 120.

Figure 12:
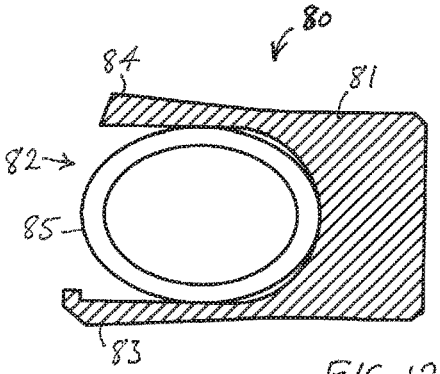
FIG. 12 is a cross section through one of the seals.

In the illustrated embodiment, each of the annular seals of the spaced seal assembly and of the stacked seal assembly is identical to the example seal 80 shown in FIG. 12, comprising a body 81 of plastics material. In the seals 61, 62, 66 of the spaced seal assembly 60, the seal body 81 may be made from polytetrafluoroethylene (PTFE), while in the seals of the stacked seal assembly 74 the seal body 81 may be made from ultra high molecular weight polyethylene (UHMWPE). Other materials, particularly those suitable for cryogenic service, may be used as known in the art.

Each seal body is sufficiently flexible to compensate for thermal expansion and contraction in the seal carrier and housing, and defines an open mouth 82 in which an annular coil spring 85 is arranged to provide an energising force which urges the opposed, radially inner lip 83 and outer lip 84 of the seal, respectively radially inwardly and outwardly to maintain them in sliding engagement with the respective cylindrical seat 51, 71 of the seal carrier and the cylindrical internal wall of its housing 6. Each seal is arranged in its use position so that its open mouth 82 faces towards the direction of fluid pressure, which also urges the lips 83, 84 radially inwardly and outwardly to further energise the seal when it is exposed to fluid pressure in use. Of course, other types of seal could be used if preferred.

In order to replace the spaced seal assembly 60, the spaced seal assembly carrier 50 is first unscrewed from the return spring rod 120 and the spacer 65 removed to expose the access end 52 of the carrier.

Preferably as shown in FIG. 5, a transverse section area of the spaced seal assembly carrier 50 at each seat region is not less than a maximum transverse section area of the spaced seal assembly carrier between each seat region and the access end. It will be understood that the pushrod components are generally cylindrical in cross section, so the transverse section area corresponds to the diameter D1 at each seat region 51 (see FIG. 5). Advantageously, the diameter D1 may be constant as shown from the shoulder 54 to the access end 52 so that the entire portion of the spaced seal assembly carrier over which the seals will travel is cylindrical.

This makes it possible for the entire spaced seal assembly 60 to slide axially along the seal carrier so that it can be easily removed from the access end 52 without being excessively distorted. A new spaced seal assembly can then be installed by sliding it onto the seal carrier over the exposed access end 52 before re-attaching the spaced seal assembly carrier 50 to the return spring rod 120. This in turn makes it possible to use relatively hard seal materials, suitable for cryogenic service, and moreover, since the seals do not relax into the seat region, to ensure that the seals provide adequate sealing pressure even in applications where the pump may stand idle for some time so that the spaced seal assembly carrier and other warm end components contract as they become gradually chilled by conduction of heat to the cold end.

In use, the seals are restrained in the axial direction of the pushrod assembly by the above mentioned abutment surfaces. It will be appreciated that in conventional assemblies where the abutment surfaces are arranged in fixed relation on a shaft and one or more seals must be installed between them, sufficient clearance must be provided for the seals to pass between the abutment surfaces and settle into the installed position. This results in a degree of end play, i.e. axial movement, when the shaft reciprocates.

It is found that the degree of end play is a significant factor affecting the service life of a seal assembly since it permits the seals to impact against the abutment services with every stroke of the shaft. Therefore it is found that an extended service life may be obtained by reducing or eliminating end play. This may be achieved by providing a screw threaded connection extending in the axial direction of the pushrod assembly between the or each seal carrier (having a shoulder defining one respective abutment surface) and the respective adjacent pushrod component which defines the opposed abutment surface. The seals are thus constrained between the abutment surfaces which can be brought together to eliminate or nearly eliminate end play while providing easy installation and replacement of the seals.

In order to ensure that end play is minimised, additional shims or spacers and/or annular retaining springs such as wave washers or the like (not shown) may be included in the or each seal assembly. Measured shim or spacer packs may similarly be used to adjust the seal assembly for different types or numbers of seals.

The axial screw threaded connection is formed between the cooperating threads on the respective seal carrier and adjacent pushrod component, comprising the threaded stud or shaft (i.e. rod or male element) and the threaded receptacle (i.e. bore) which extend in the axial direction of the pushrod assembly so that when engaged together they place the stud in tension. In the illustrated embodiment the threaded stud is formed integrally with a respective one of the connected pushrod components, although in alternative embodiments a separate stud may be threaded at both ends to engage in a respective threaded bore formed in each of the two connected components.

Preferably, the spacers 63 and 65 and the spaced seal assembly carrier 50 have substantially equal coefficients of thermal expansion, so that end play remains substantially unaffected by thermal expansion or contraction of the assembly.

Referring to FIG. 7, the pushrod housing 6 includes a vented region 28 having a fluid passageway 29 acting as a vent which opens at one end into the vented region 28 of the housing and at the other into the chamber 26, so that any pressure developed in the vented region of the housing is relieved (e.g. to atmosphere) via the chamber 26.

In use, the first and second annular seals 61 and 62 slidingly engage the housing 6 to sealingly isolate the vented region 28 between them.

Preferably, the first and second annular seals 61, 62 are configured as shown and best seen in FIG. 9 to be biased radially outwardly by fluid pressure from the driving end 20 of the assembly. The spacer 63 has a reduced external diameter along most of its length so that an annular space is defined between the spacer and the housing 6. This allows any pressure developed above the first annular seal 61 and leaking past it to dissipate via the vent, so that the second annular seal 62 prevents hydraulic fluid (e.g. hydraulic oil) from travelling further down the pushrod assembly.

Further as shown and best seen in FIG. 9, the spaced seal assembly 60 may include a third annular seal 66, with the first and second annular seals 61, 62 and the spacer 63 being axially interposed between the third annular seal 66 and the driving end 20 of the assembly. The third annular seal 66 is configured to be biased radially outwardly by fluid pressure from the driven end 30 of the assembly, so that it prevents any LNG or vapor present in the housing 6 beneath it from travelling to the driving end 20 of the pump.

It will be noted that each pushrod component is provided at one or both ends with a bearing surface 130, which is slightly rounded or barrelled in the axial direction so that it slidingly engages the polished internal surface of the housing 6 while tolerating slight misalignment of the assembly in the housing.

Figure 11:
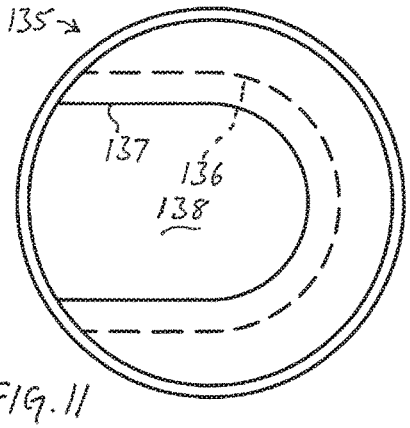
FIG. 11 is an end view of a female coupling element.

Referring to FIGS. 5 and 6 and FIG. 11, the elongate central pushrod 100 may be made from the same material as the other pushrod assembly components, e.g. stainless steel, and is provided at each end with a male coupling element 132 comprising a short, cylindrical flange 133 formed at the distal end of a cylindrical stem 134, all forming a surface of rotation about the axis X. Each of the adjacent components, comprising the spaced seal assembly carrier 50 and a connector 140, is provided with a cooperating female coupling element 135, seen in end view in FIG. 11, comprising a recess 136 and a collar 137. Before installing the pushrod assembly components into the housing 6 they are coupled together by inserting the flange 133 of the male coupling element into the recess 136 so that the stem 134 passes through the collar 137. When inside the housing, the collar 137 restrains the flange 133 in the axial direction while the compressive force is transmitted by abutment of the opposed axial end surfaces 138 of the coupled components. One of the end surfaces 138 of each component may be flat while the other is slightly domed, so that contact is maintained during the compression stroke with all or nearly all of the force being vectored in the direction of the axis X, even if the components are slightly misaligned in the housing 6.

The connector 140 is provided with a threaded receptacle 141 similar to the receptacle 124 of the return spring rod, while the stacked seal assembly carrier 70 is provided at its access end 72 with a threaded stud or shaft 73 similar to the shaft 53 of the spaced seal assembly carrier. The shaft 73 and receptacle 141 extend in the axial direction and may be detachably connected together with the same torque and axial tension in relation to the elastic limit of the stud material as described above to provide a similarly reliable threaded connection.

Figure 10:
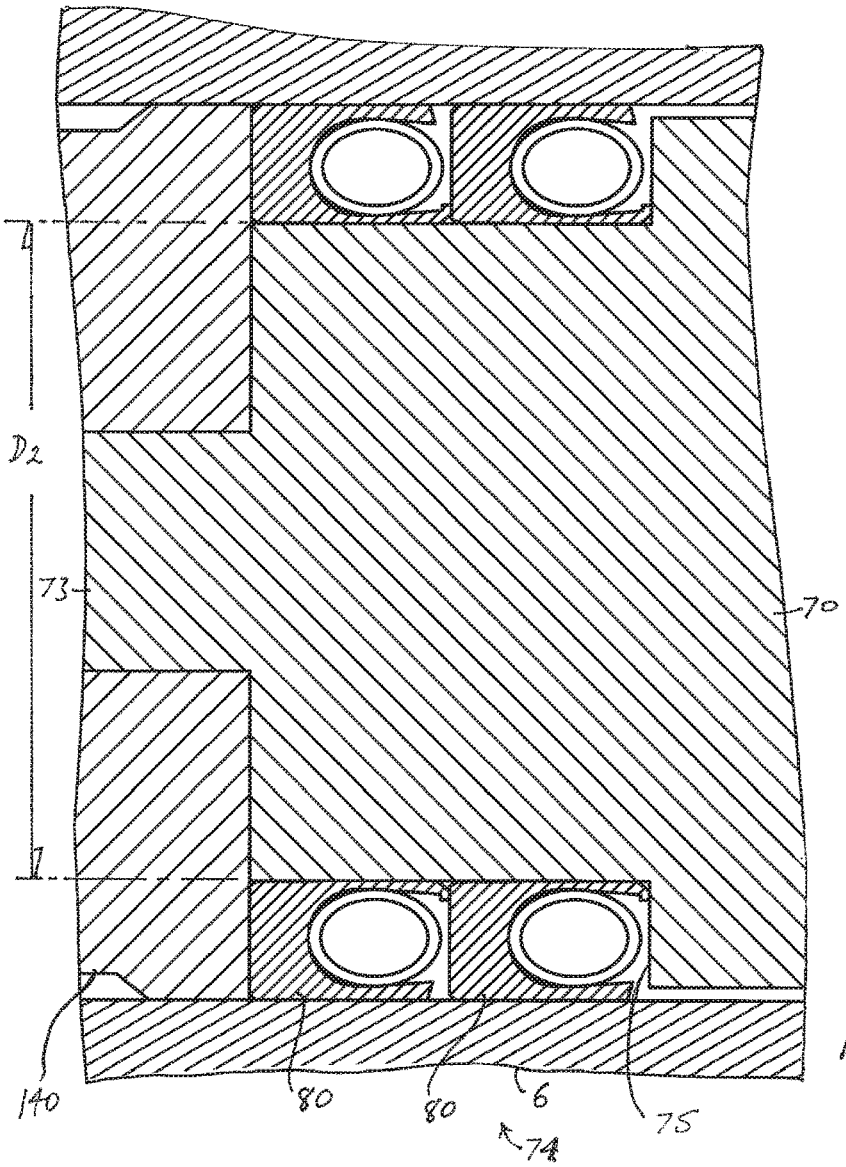
FIG. 10 is an enlarged longitudinal section through part of the stacked seal assembly carrier in its use position in the pumping end of the cryogenic pump.

Referring particularly to FIGS. 8 and 10, the stacked seal assembly carrier 70 extends axially through a stacked seal assembly 74 which includes at least two annular seals 80 arranged in axially abutting relation, each of which is preferably configured to be further energised (i.e. biased radially inwardly and outwardly) by fluid pressure from the same direction, e.g. as shown, from the driven end 30 of the assembly, so that the open mouth 82 of each seal faces downwardly towards that end.

The stacked seals 80 are arranged in series on the seat region 71 of the stacked seal assembly carrier and retained between axially opposed abutment surfaces of the pushrod assembly, defined by the shoulder 75 of the stacked seal assembly carrier and the opposed axial end surface 142 of the connector 140, to slidingly engage the pushrod housing.

Assembly and disassembly is generally the same as for the spaced seal assembly carrier discussed above. Preferably as shown, a transverse section area of the stacked seal assembly carrier 70 at the seat region 71, corresponding to its diameter D2 (see FIG. 10) in the illustrated embodiment, is not less than a maximum transverse section area of the stacked seal assembly carrier between the seat region and its access end 72. In the illustrated example, the stacked seal assembly carrier 70 is cylindrical between its shoulder 75 and access end 72, so that when detached from the connector 140 the access end 72 can easily be slidingly axially inserted into the stacked seal assembly 74.

The stacked seal assembly may be arranged to operate at a cryogenic temperature proximate the driven end of the assembly as shown.

The stacked seal assembly carrier 70 is provided at its lower end with a female coupling element 135 which receives a male coupling element 132 on the upper end of the cryogenic pumping element 40 to form another releasable coupling as described above.

As best seen in FIG. 8, the cryogenic pumping element 40 may comprise a piston 41 which is axially aligned with the actuator 90 and other, intervening components of the pushrod assembly.

The pushrod assembly housing 6 terminates at the driven end 30 of the pump at a lower assembly 32 which defines for each pushrod assembly a chamber 33 which fluidly communicates via a non-return valve 34 with the space inside the filter 31 so that the cryogenic liquid 4 contained in the tank can pass through the filter into the chamber 33. The chamber fluidly communicates via a second non-return valve 35 with the inlet manifold 8 of the high pressure supply tube 7.

The piston 41 is slidingly received in the chamber 33 containing the cryogenic liquid and sealingly engaged with the internal wall of the chamber without any resilient sealing element between the piston and the wall. The piston 41 and chamber 33 may be cylindrical as shown, and made for example from stainless steel with a composition and surface treatment suitable for cryogenic service as known in the art, providing a high pressure pumping action with long service life which is not limited by any resilient sealing element. As the piston reciprocates in the chamber it draws cryogenic fluid up through the valve 34 on the upstroke and then forces it under pressure via the second valve 35 through the high pressure supply tube 7 to the fuel outlet 9 on the downstroke. The operation of the six actuators 90 of the six pushrod assemblies (only one of which is shown) may be sequenced to provide a more constant flow rate.

Cryogenic fluid leaking past the piston 41 is blocked by the stacked seal assembly 74 from travelling up the pushrod housing 6 towards the warm, driving end 20 of the pump. It will be noted that no vent is provided between the adjacent seals 80 of the stacked seal assembly 74. Instead, the stacked seals 80 may be regarded as a multiple redundant sealing system, wherein the expected working life (time to failure) of each seal 80 is dependent principally on the pressure across the seal. Thus, after failure of the lowermost seal in the stack, since all of the stacked seals are arranged to be energised by fluid pressure from the same direction, the adjacent seal begins to be energised by the fluid pressure and thereafter functions to prevent leakage until it, too, fails after a similar, further time period. Additional seals 80 may be provided and similarly arranged to further multiply the working life of the stacked seal assembly 74 before the stack of seals 80 must be replaced.

The stacked seal assembly carrier 70 and the piston 41 of the cryogenic pumping element may be arranged to be axially withdrawable together from the pushrod housing 6 at the driven end 30 but not at the driving end 20. This ensures that the stacked seal assembly 74 and the cryogenic piston 41 are not withdrawn and re-installed together through the entire length of the pushrod housing 6, which could lead to damage to the seals 80 and the polished surface of the piston 41.

This can be accomplished by providing the cryogenic piston 41 to have a slightly larger diameter than the stacked seal assembly carrier 70 and pushrod housing 6. In order to replace the stacked seal assembly 74, the pump is released at the mounting flange 22 and withdrawn from the tank 3. The filter 31 is removed from the lower end of the pump, and then the upper assembly 21 and lower assembly 32 are disconnected and removed from the pushrod housing assembly which forms the axially central portion of the pump. The pushrod assembly is urged down in its housing 6 to expose the coupling 135, 132 of the cryogenic pumping element 40, which is disconnected at the coupling from the rest of the pushrod assembly. The pushrod assembly is then partially withdrawn from the upper end of the pushrod housing 6 to expose the spaced seal assembly carrier 50, which can be disconnected from the central pushrod 100 at the upper pushrod coupling 135, 132. The remaining components of the pushrod assembly are then withdrawn from the lower end of the pushrod housing 6 and the stacked seal assembly carrier 70 disconnected at the lower pushrod coupling 135, 132. The seal assembly carriers 50, 70 can then be unscrewed from the adjacent pushrod components before sliding the worn seal assemblies 60, 74 off the access end of each carrier 50, 70. New seal assemblies 60, 74 are fitted and installed by reversing the above described steps.

Further advantageously, since the seals 80 are not required to pass through the axially central region of the housing 6 which in use receives the reduced diameter region 101 of the central pushrod, this region of the housing (which occupies most of its length) need only be semi-finished.

In summary, a pushrod assembly may include a seal carrier for a spaced seal assembly and/or a seal carrier for a stacked seal assembly, the spaced seal assembly including first and second annular seals separated by a spacer to isolate between the seals a vented region of the pushrod housing, the stacked seal assembly including at least two annular seals stacked on the seal carrier. Each seal assembly can be removed and replaced via an access end of the seal carrier after detaching the access end from an adjacent component of the assembly. The seal carriers may be incorporated into a cryogenic pump wherein at least one annular seal is arranged on each seal carrier to seal the pushrod assembly within its housing.

INDUSTRIAL APPLICABILITY

Although the pushrod assembly has been disclosed in a cryogenic pump for use in supplying LNG to an internal combustion engine, it will be understood that it may be employed also in cryogenic and non-cryogenic pumps for other applications, which may be driven by hydraulic or non-hydraulic (e.g. electrically powered) actuators.

The spaced seal assembly and stacked seal assembly may be arranged respectively at the driving end and the driven end of a cryogenic pump as shown, although they could alternatively be arranged at any position along a reciprocal pushrod assembly in a pump. Either of the spaced and stacked seal assemblies could also be used without the other. Rather than being vertically oriented as shown, the pump could of course be arranged in any orientation, either within a cryogenic tank or in any other use situation, and references herein to "upper" and "lower" regions should be construed mutatis mutandis.

Embodiments facilitate installation and replacement of the seals, by withdrawing the pushrod assembly and then disconnecting the seal carrier from the adjacent component before sliding the seals axially over a portion of the seal carrier which is no greater in diameter than the seat. This also ensures that the seal can be maximally energised when positioned on the seat, and allows the use of relatively hard seal materials such as PTFE and UHMWPE which are particularly suitable for cryogenic applications.

When the seal carrier is reconnected to the adjacent component, the opposed abutment surfaces on the seal carrier and the adjacent component may be advanced axially towards each other as the components are screwed together until the seals are snugly captured between them. This limits the end play (axial freedom of movement) of the seals on the seal carrier and so provides extended service life by preventing impact damage between the seals and the abutment surfaces as the shaft reciprocates.

A screw threaded connection between the seal carrier and the adjacent component is particularly effective in applying axial pressure to the seals to limit end play. If required, the seal assembly may include shims and/or spacers (not shown) which are arranged axially between the seals and abutment surfaces to prevent axial motion of the seals when the assembly is to be used with different numbers of seals or seals of different axial lengths. Of course, rather than two or three seals, each seal assembly could comprise a single seal or three or more seals. By limiting the tension force applied to the assembly in service, it is possible to provide a particularly secure threaded connection by torquing the components to a high proportion of their elastic yield strength.

Of course, if preferred, other detachable connections may be provided in place of the threaded connections and couplings described above.

The vent between the first and second annular seals 61, 62 of the first seal assembly provides more effective sealing, particularly for example in vehicular applications when the pump may have been standing outdoors in cold weather while the vehicle is at rest so that the warm end is progressively cooled by the cryogenic fluid in the tank while absorbing little ambient heat from the environment. When the pump is first started, the components at the warm end may thus be much colder than their usual operating temperature so that the seals are relatively less tight. In such situations, any pressure leaking past the first seal at the warm end is relieved by the vent, so that the second seal is able to prevent the hydraulic fluid from travelling down the pushrod.

As shown, the first and second seals 61, 62 may be separated by a spacer 63 having a coefficient of thermal expansion substantially equal to that of the spaced seal assembly carrier 50. The spacer 63 extends axially along the carrier to define an axial abutment surface for the or each seal, which due to the matched coefficients of thermal expansion remains at the same axial distance from the opposed abutment surface of the adjacent component, further reducing end play as the temperature of the assembly fluctuates.

Many further possible adaptations within the scope of the claims will be evident to those skilled in the art.

What is claimed is:

1. A pushrod assembly for use in a pump having a housing with a vented region, the pushrod assembly including:

a plurality of pushrod components operatively connected together in series along an axis of the assembly to transmit reciprocal motion between a driving end and a driven end of the assembly, said pushrod components including a spaced seal assembly carrier; and a spaced seal assembly, the spaced seal assembly including at least a first annular seal, a second annular seal, and an annular spacer;

the spaced seal assembly carrier extending axially through the spaced seal assembly with the spacer axially interposed between the first annular seal and the second annular seal, each of the first annular seal and the second annular seal being received on a respective seat region of the spaced seal assembly carrier and retained between axially opposed abutment surfaces of the pushrod assembly;

the pushrod assembly being receivable in the housing of the pump in a use position wherein the first and second seals slidingly engage the housing and sealingly isolate the vented region of the housing between the first annular seal and the second annular seal;

wherein the spaced seal assembly carrier has an access end and is detachably connectable at the access end to an adjacent one of the pushrod components so that when detached the access end can be slidingly axially inserted into the spaced seal assembly.

2. A pushrod assembly according to claim 1, wherein a transverse section area of the spaced seal assembly carrier at each seat region is not less than a maximum transverse section area of the spaced seal assembly carrier between each seat region and the access end.

3. A pushrod assembly according to claim 1, wherein the spacer and the spaced seal assembly carrier have substantially equal coefficients of thermal expansion.

4. A pushrod assembly according to claim 1, wherein the spaced seal assembly carrier is arranged proximate the driving end of the assembly;

and the first annular seal and the second annular seal are configured to be biased radially outwardly by fluid pressure from the driving end of the assembly;

and the spaced seal assembly includes a third annular seal, the first annular seal and the second annular seal and the spacer being axially interposed between the third annular seal and the driving end of the assembly, and the third annular seal is configured to be biased radially outwardly by fluid pressure from the driven end of the assembly.

5. A pushrod assembly for use in a pump having a housing, the pushrod assembly including:

one or more pushrod components configured to transmit reciprocal motion along an axis of the assembly between a driving end and a driven end of the assembly, said one or more pushrod components including a stacked seal assembly carrier; and a stacked seal assembly, the stacked seal assembly including at least two annular seals;

the stacked seal assembly carrier extending axially through the stacked seal assembly, the at least two annular seals being arranged in series on a seat region of the stacked seal assembly carrier and retained between axially opposed abutment surfaces of the pushrod assembly;

the pushrod assembly being receivable in the housing of the pump in a use position wherein the at least two annular seals slidingly engage the housing;

wherein each of the at least two annular seals is configured to be biased radially outwardly by fluid pressure from the driven end of the assembly, and the stacked seal assembly carrier has an access end and is detachably connectable at the access end to an adjacent one of the one or more pushrod components so that when detached the access end can be slidingly axially inserted into the stacked seal assembly.

6. A pushrod assembly according to claim 5, wherein a transverse section area of the stacked seal assembly carrier at the seat region is not less than a maximum transverse section area of the stacked seal assembly carrier between the seat region and the access end.

7. A pushrod assembly according to claim 5, wherein the stacked seal assembly is arranged to operate at a cryogenic temperature proximate the driven end of the assembly.

* * * * *